United States Patent [19]

Etter et al.

[11] 4,115,125

[45] Sep. 19, 1978

[54] POLYMERIC FILMS PEELABLY ADHERED TO A PRESSURE-SENSITIVE ADHESIVE PHOTOGRAPHIC ELEMENT

[75] Inventors: Doyle O. Etter; Irvin H. Crawford, both of Rochester, N.Y.

[73] Assignee: Eastman Kodak Company, Rochester, N.Y.

[21] Appl. No.: 794,857

[22] Filed: May 9, 1977

[51] Int. Cl.[2] ..... G03C 1/86

[52] U.S. Cl. ..... 96/83; 428/521; 156/244.27; 96/85

[58] Field of Search ..... 96/85, 83; 428/521; 156/244

[56] References Cited

U.S. PATENT DOCUMENTS

| | | | |
|---|---|---|---|
| 3,135,608 | 6/1964 | Dickard | 96/83 |
| 3,359,107 | 12/1967 | Goffe et al. | 96/83 |
| 3,411,908 | 11/1968 | Crawford et al. | 96/85 |
| 3,582,337 | 6/1971 | Griggs et al. | 96/85 |

FOREIGN PATENT DOCUMENTS

| | | | |
|---|---|---|---|
| 20,014/77 | 2/1977 | Japan. | |
| 1,101,608 | 1/1968 | United Kingdom | 96/85 |

*Primary Examiner*—John D. Welsh
*Attorney, Agent, or Firm*—Torger N. Dahl

[57] ABSTRACT

A photograpic element having a pressure-sensitive adhesive layer for mounting of the element as desired, is protected by an ethylene polymer layer having a defined melt index and applied thereto by extrusion, with or without included antioxidant, at temperatures above 450° F. As a consequence of the defined extrusion conditions, the protective ethylene polymer layer can be applied to form the element at high line speeds, and, when subsequently desired, peeled from the adhesive layer to which it is adhered by a force not exceeding 400 grams as defined. Ethylene polymers that are employed include polyethylene, and copolymers of ethylene with other monomers.

8 Claims, No Drawings

POLYMERIC FILMS PEELABLY ADHERED TO A PRESSURE-SENSITIVE ADHESIVE PHOTOGRAPHIC ELEMENT

BACKGROUND OF THE INVENTION

1. Field of the Invention

The present invention relates to photographic elements bearing pressure-sensitive adhesive layers protected by overlaying peelable film layers. The invention in particular relates to the preparation of such elements by melt extrusion of the film onto the adhesive layer.

2. The Prior Art

Self-adhesive or pressure-sensitive adhesive photographic elements have gained widespread acceptance in the present day. Their use extends to the phototypesetting industry in which developed photographs are normally mounted adhesive side down onto so-called composition or mounting boards. The mounted photographs, moreover, can be removed and re-positioned until a satisfactory composition of photographs along with other material is achieved. Similarly, in the area of amateur photography, photographs can be mounted in albums by means of pressure-sensitive adhesives as in the phototypesetting industry.

Both of the above areas of use, as well as others, at some point in time require the application of adhesive to the photographic element, a potentially messy and inconvenient procedure. As a convenience to the user, manufacturers of photographic elements have precoated, for example, pressure-sensitive adhesives onto the paper support for photographic elements. To preserve the adhesive qualities of the adhesive layer, avoid premature sticking of the coated photographic elements to each other or unwanted surfaces, and prevent contact of the adhesive layer with photographic processing baths encountered by the element before use, protective layers, typically polymeric films, are applied over and in contact with the adhesive layer. The protective layer can then be removed at a chosen time to expose the pressure-sensitive adhesive layer for mounting as desired. See British Pat. No. 1,101,608 to Sandoz Ltd., published Jan. 31, 1968 for a description of such protective layers on pressure-sensitive layers of photographic elements. The subject of protective layers for pressure-sensitive adhesive layers on photographic elements is further disclosed in Dickard U.S. Pat. No. 3,135,608 issued June 2, 1964. In the latter patent, conventional release paper is laminated to the pressure-sensitive adhesive layer of a photographic element as discussed above. Particular protective layers with which the invention described below is concerned comprise ethylene polymers, such as polyethylene. The use of such materials has long been established in the photographic industry.

Techniques that are known to exist for applying protective layers onto pressure-sensitive adhesive layers, include lamination, solvent coating, in-situ polymerization, and extrusion. Of these, lamination or extrusion are often employed in the application of ethylene polymers. In contrast to extrusion coating of a polymer layer directly onto a substrate, the process of lamination is necessarily preceded by a preformation step which includes off-line extrusion of a film and distinct storage thereof in roll form on a tubular core. Lamination subsequently includes unwinding the preformed film and bringing it into cold contact with the adhesive coated substrate — in this instance, photographic paper base.

At first blush, the procedure of lamination may not seem undesirable. Off-line formation of the film, however, is inherently more costly in terms of film storage, winding operations, and the need for separate operating space, when compared to direct extrusion onto the substrate. Equally significant, the thickness of film that must be used in lamination is quite large by comparison to the thickness of film applied by extrusion. Lamination of thin film, such as 1 mil thick film, is quite difficult, often resulting in a wrinkled surface. Wrinkling, in turn, creates additional problems when the substrate with film protected adhesive layer is stored, emulsion coated, and processed in photographic baths. Such is not the case with extrusion, as the molten extruded film has a much greater tendency to maintain surface uniformity upon contacting the adhesive surface of the substrate.

The direct extrusion of ethylene polymers onto pressure-sensitive adhesive coated substrates has encountered several problems related to the temperature of extrusion, the ease with which the polymer layer can be detached from the adhesive layer when mounting is desired, and the line-speed capacity of extrusion.

It will be appreciated, that if the bond between the ethylene polymer layer and the adhesive layer is excessive, any attempt to detach the film layer as desired will result in the rupture of either the polymer film layer or the paper substrate on which the adhesive is coated. Empirically it has been found that the stripping force to overcome that bond should not exceed about 400 grams as determined by the stripback test described in greater detail hereinafter.

Furthermore, as the temperature of extrusion is lowered, the coherent strength of the ethylene polymer "curtain" before striking an advancing substrate is significantly reduced. As a consequence, the polymer curtain has a greater propensity to tear unless the speed of the advancing substrate is significantly lowered, in turn adversely affecting the economic success of the operation. The temperature at which the strength of the curtain becomes unacceptable depends in part on the melt index, or viscosity, of the material extruded, the more viscous materials requiring higher extrusion temperatures to avoid curtain tearing. As a general matter, however, ethylene polymers having melt indices, as later defined, within the range from about 3 to 14 cannot be extruded at 450° F (232° C) or lower without sacrificing line speed.

On the other hand, extrusion of the ethylene polymer layer at high extrusion temperatures such as above 580° F (304° C), while providing adequate coherent strength to the curtain and permitting higher line speeds, can result in bond strengths between the ethylene polymer layer and adhesive layer in excess of 400 grams. Furthermore, in extrapolating the results of high temperature extrusion to determine what might happen on decreasing the extrusion temperature, data indicated that a bond strength for permitting strippability of the ethylene polymer layer (i.e., a bond requiring less than a 400 gram force as described herein) would not have been expected at extrusion temperatures above about 450° F. Hence it appeared that extrusion of ethylene polymers onto pressure-sensitive adhesive layers to produce 400 gram or less bond strengths would have to be carried out at 450° F or lower extrusion temperatures at unacceptably low line speeds.

SUMMARY OF THE INVENTION

In accordance with the invention, a bond strength of less than 400 grams between an extruded ethylene polymer layer and a pressure-sensitive adhesive layer on a photographic paper support has been discovered to occur at temperatures of extrusion above 450° F (232° C) for ethylene polymers having a melt index in the range from about 3 to 14. When the ethylene polymer is extruded without included antioxidant, the extrusion temperature range extends from about 450° to about 540° F (282° C), while the addition of antioxidant can increase the upper end of the range even further to about 600° F and higher without sacrificing bond strength requirements as defined. Consequently, the problems of polymer curtain tears or offsetting low line speed associated with extrusion temperatures below 450° F, and excessive (non-strippable) bond strengths associated with high extrusion temperatures are substantially avoided. Thus, the invention provides a photographic element which comprises a paper support, an imaging layer on one surface of the support, a pressure-sensitive adhesive layer bonded to the reverse surface of the support, and an ethylene polymer layer peelably adhered to the adhesive layer by application under the temperature conditions defined above and having a melt index as indicated. The ethylene polymer layer of such an element can be peeled away by a force not exceeding 400 grams, as defined herein, and has the added advantage of being wrinkle-free at low thicknesses, for example, at thicknesses of 1 mil or less.

DETAILED DESCRIPTION OF THE INVENTION

In accordance with this invention, it has been discovered that at extrusion temperatures above 450° F an ethylene polymer having a melt index within the range from about 3 to 14 exhibits adequate coherent strength during such extrusion and forms a layer having acceptable strippability, as defined, from a pressure-sensitive adhesive layer on a paper support. The particular extrusion temperature that can be employed is in part dependent on obtaining a less than 400 gram strength for the ethylene polymer-to-adhesive bond, and in part dependent on the presence or lack of an antioxidant. Having formed the polymer coated paper support, the reverse surface of the support is provided with an imaging layer to produce thereby a photographic element with the strippability advantages herein described. It should be emphasized, of course, that the obtaining of less than 400 gram bond strengths stemming from extrusion at temperatures in excess of 450° F was not expected.

Determination of the strength of the polymer to adhesive bond is accomplished by measuring the force in grams to peel a ½ inch wide strip of ethylene polymer from the adhesive layer of a photographic paper support. Prior to the actual measurement, adhesive-coated paper onto which the ethylene polymer has been freshly extruded, is aged for at least 15 days at normal room temperature. Next, a ½ inch wide, 10–18 inch long strip of the element to be tested is provided. A ½ inch long segment of the ½ inch wide polymer is manually detached from the adhesive layer to form an edge which is folded back 180°. The remainder of the polymer is then detached from the strip by pulling the folded-back edge so that release is effected at a rate of 10 inches per minute in the 180° direction. The minimum force in grams required to effect such release rate is defined as the bond strength for purposes of this invention.

In general, any of a wide variety of pressure-sensitive adhesives can be employed in the invention as a coating on a photographic paper support. The choice of adhesive, of course, has some influence on the strength of the polymer-to-adhesive bond as defined, such that at the same extrusion temperature, different adhesives produce slightly different bond strengths. As the objective herein is to produce bond strengths not exceeding 400 grams, the pressure-sensitive adhesive chosen for use can be accommodated by varying the extrusion temperature above 450° F to achieve the desired bond strength. It should be pointed out that bond strengths can be achieved as low as 50 to 200 grams within the same defined temperature range, lower bond strengths being preferred.

The ethylene polymers of this invention can be extruded with or without antioxidant as an additive in the polymer melt. As indicated above, the effect of antioxidant addition is to extend the useful extrusion temperature range to about 600° F and higher, without sacrificing strippability as defined. Useful antioxidants are those which have the effect of reducing oxidation of the ethylene polymer at conventional temperatures of extrusion, i.e., temperatures in excess of 600° F. Preferred antioxidants include phenols such as octadecyl-3-(3′,5′-di-tert-butyl-4′-hydroxyphenyl)propionate; bisphenols such as octyl-bis-(3-tert-butyl-6-methyl-4-hydroxyphenyl)methane; and dialkyl phenol sulfides such as disclosed in Salyer et al U.S. Pat. No. 3,170,893. Suitable other antioxidants include, for example, 6-nonyl-2,4-xylenol; 4,4′-butylidene-bis-(6-t-butyl-m-cresol); tetrakis{methylene-3-(3,5-ditert-butyl-4-hydroxyphenyl propionate)}; condensates of 3-methyl-6-t-butylphenol and crotonaldehyde; ortho cyclohexylphenol; n-lauroyl-p-aminophenol; 2′2-methylenebis-(4-methyl-6-t-butylphenol); 1,3,5-trimethyl-2,4,6-tris(3,5-di-tert-butyl-4-hydroxybenzyl)benzene; and others.

Antioxidants, furthermore, when employed in the ethylene polymer melt, can be present in a concentration from about 0.2 to 1 percent by weight of ethylene polymer.

Pressure-sensitive adhesives, as employed herein, can consist of a tacky resin or polymer. Alternatively, an intrinsically non-tacky polymer or elastomer can be tackified by the addition of a tacky resin or plasticiser. Suitable tackifiable polymers are, e.g., natural unvulcanized rubber, synthetic rubber such as polyisobutylene, polychloroprene; polybutadiene; polyacrylonitrile and copolymers of these with styrene and styrene homologues and acrylic monomers; polyvinyl alkyl ethers such as methyl, ethyl and butyl ethers; acrylic and methacrylic polymers such as polybutyl acrylate and its copolymers and polybutyl methacrylate; and vinyl acetate polymers.

Tacky and tackifying resins for use in the adhesives are, e.g., rosin and rosin derivatives such as hydrogenated rosin esters and alcohols, liquid polymer styrene and styrene homologues; polymerised terpenes such as α-pinene; ketone resins; low molecular weight polyisobutylenes and other olefins.

If required, a tack-controlling agent may be added preferably in the form of a soft or easily deformable material to allow good flow and contact with the receiving surface. Particularly suitable materials are long-chain hydrocarbons containing 12 or more carbon atoms such as paraffin and polyethylene waxes, fatty acids and their derivatives and polyethylene glycols.

Other pressure-sensitive adhesives which can be employed in the invention are described in Bolduc U.S. Pat. No. 3,907,557 (issued Sept. 23, 1975); Bergstedt et al U.S. Pat. No. 2,953,475 (issued Sept. 20, 1960); and Reed U.S. Pat. No. 3,257,228 (issued June 21, 1966).

Ethylene polymers, as employed herein, include homopolymers of ethylene, and can also include copolymers of ethylene with such monomers, for example, as other olefins including propylene and the like, vinyl acetate, and acrylics including acids and esters such as acrylic acid and ethyl acrylate. When copolymers of ethylene are employed, it is preferable to have at least about 30 mole percent ethylene monomer in the copolymer.

As indicated earlier, the ethylene polymers utilized in this invention have a melt index within the range from about 3 to 14. Preferably such melt index is in the range from about 6 to 12. A most preferred melt index is about 7.5. As the term is used herein, melt index refers to the number of grams that flow through an orifice in 10 minutes at standardized conditions as defined in ASTM D-1238-65T; Condition "E."

Various ethylene polymer layer coverages can be employed on the pressure-sensitive adhesive layer in accordance with this invention. Suitable coverages range from about 2.5 to 6 pounds per 1000 $ft^2$.

The pressure-sensitive layer can be applied to a photographic paper substrate by conventional techniques such as by gravure coating. Suitable coatings of adhesive are obtained employing a triangular helix gravure roll with cell depths from about 0.5 to 4 mils and from 100 to 200 lines per inch. After coating, the adhesive layer can be dried at temperatures between 225° F and 275° F. Typical dry coatings of adhesive are in the range from about 0.25 to 2 pounds per 1000 $ft^2$.

The stripping ability of the ethylene polymer layer described herein can further be modified if desired by the inclusion in the polymer layer of additives such as release or slip agents. Preferred additives are amides such as n,n-diethanol oleamide, erucamide or stearylerucamide in concentrations from about 0.1 to 4 percent by weight of ethylene polymer. Use of the n,n-diethanol amide has the added advantage of serving as an antistatic agent especially in concentrations from about 1 to 4 percent.

The strippability of the ethylene polymer from the pressure-sensitive adhesive layer can also be modified by the inclusion of additives in the adhesive layer. Suitable additives include silicon materials such as dimethyl siloxane in a concentration from about ½ to 5 percent by weight of adhesive.

Antistatic layers can also be employed to advantage in the elements of this invention. For example, after applying the polymer layer to the adhesive layer by extrusion as defined, an antistatic layer can be coated on the polymer layer. Suitable antistatic layers can include polystyrene sulfonic acids, and mixtures thereof with polyvinyl alcohol, and multi-layer arrangements comprising a gel layer first covered by a sodium cellulose sulfate layer. Antistats can be coated in amounts ranging from about 0.1 to 2 pounds per 1000 $ft^2$ of coated surface.

In the photographic element of this invention there is included a photographic imaging layer on the side of a paper support opposite to the pressure-sensitive adhesive layer and ethylene polymer layer covering the adhesive layer. Imaging layer, in this regard, signifies an unexposed, latent-image bearing, or image-bearing photographic layer. By way of example, suitable layers can be of the silver halide or non-silver halide photosensitive type.

In the practice of this invention, the extrusion of the ethylene layer can take place at high line speeds as a consequence of the extrusion temperature within the defined range giving the desired bond strength as mentioned previously.

The photographic paper support that can be employed in the practice of this invention includes a paper substrate. Such paper typically has a basis weight in the range from about 8 to 60 pounds per 1000 $ft^2$, 14 to 18 pounds per 1000 $ft^2$ being typical for phototypesetting products and about 36 pounds per 1000 $ft^2$ for photographic print products. Also, the paper support can include in addition to the paper substrate, one or more additional layers between the substrate and the photographic emulsion layers. An example of such additional layer is a polyethylene layer extruded directly onto the paper substrate.

The following examples are included to better aid in understanding the invention.

EXAMPLE 1

Pressure sensitive adhesives of various commercially available types were gravure coated at a wet coat coverage of about 1 lb/1000 $ft^2$ on respective paper supports, and thereafter dried to form adhesive layers. Low density polyethylene having a melt index of 7.5 was next extrusion coated at various melt temperatures onto the adhesive layer of the respective supports. The coating operation was such that the extruded polyethylene, in the form of a curtain extending from an extrusion die, and the adhesive layer met as they entered the nip formed between a chill roll and a pressure roll. The die-to-nip distance was about 5 inches and the linear speed of the paper support advancing to meet the polyethylene curtain varied from 100 to 180 feet per minute.

The resulting elements were next evaluated to determine the strength of the polyethylene-to-adhesive bond expressed as the force in grams to peel the polyethylene layer from the adhesive layer in accordance with the stripback procedure defined herein. Results are shown in Table I.

TABLE I

| | Bond Strength, in grams, At Indicated Extrusion Melt Temperature (° F) | | | | | | |
|---|---|---|---|---|---|---|---|
| Adhesive | 497°-504° | 518°-523° | 537°-543° | 558°-563° | 577°-584° | 598°-604° | 616°-621° |
| Covinax 179[1] | 122 | 166 | 300 | 574 | 638 | 1000+ | 635 |
| Rhoplex N-619[2] | 242 | 297 | 606 | 1000+ | 1000+ | 1000+ | 1000+ |
| Hycar 1870X-4[3] | 70 | 118 | 470 | 792 | 781 | 840 | 663 |
| Rhoplex N-560[4] | 251 | 315 | 724 | 631 | 1000+ | 1000+ | 1000+ |
| PVE 618[5] | 113 | 229 | 443 | 1000+ | 1000+ | 1000+ | 1000+ |

TABLE I-continued

| Adhesive | Bond Strength, in grams, At Indicated Extrusion Melt Temperature (° F) | | | | | | |
|---|---|---|---|---|---|---|---|
| | 497°-504° | 518°-523° | 537°-543° | 558°-563° | 577°-584° | 598°-604° | 616°-621° |
| HC 4759[6] | 225 | 255 | 547 | 1000+ | 1000+ | 1000+ | 1000+ |

[1]Covinax 179 is an n-butylacrylate pressure-sensitive adhesive marketed by Franklin Chemical Company.
[2]Rhoplex N-619 is an i-butylacrylate pressure-sensitive adhesive marketed by Rohm & Haas Chemical Company.
[3]Hycar 1870X-4 is a nitrile pressure-sensitive adhesive marketed by B. F. Goodrich Chemical Company.
[4]Rhoplex N-560 is an n-butylacrylate pressure-sensitive adhesive marketed by Rohm & Haas Chemical Company.
[5]PVE 618 is a vinylacetate pressure-sensitive adhesive marketed by Peter Cooper Corporation.
[6]HC 4759 is an acrylic pressure-sensitive adhesive marketed by Hughes Chemical Corporation.

EXAMPLE 2

The procedure of Example 1 was followed using PVE 618 pressure-sensitive adhesive except that the polyethylene melt included 1 percent (by weight polyethylene) of octadecyl-3-(3',5'-di-tert-butyl-4'-hydroxyphenyl)propionate antioxidant additive and the extrusion temperature was 575° F. After the resulting element was aged for at least 15 days at room temperature, the bond strength of the polyethylene-to-adhesive was satisfactorily low as evidenced by the integrity of both the paper support and polyethylene layer after the latter was hand-peeled from the adhesive layer.

EXAMPLE 3

Example 2 was repeated except the pressure-sensitive adhesive was Covinax 179, the antioxidant level was reduced to 0.35 percent and the temperature of extrusion was raised to 599° F. After the resulting element was aged for about 13 months at room temperature, the resulting bond strength of the polyethylene-to-adhesive was determined to be 81 grams.

The polyethylene coated paper supports of Examples 1, 2 and 3 having bond strengths of less than 400 grams as defined can be provided with an imaging layer on the surface of the support opposite the surface bearing the polyethylene layer. The resulting element can be stored, exposed, and processed to form an image with the polyethylene layer intact. Thereafter, the polyethylene layer can be peeled away to expose the pressure-sensitive adhesive surface for mounting.

The invention has been described with particular reference to certain preferred embodiments. It will be understood that variations and modifications can be effected within the spirit and scope of the invention.

What is claimed is:

1. A photographic element comprising a paper support, an imaging layer on one surface of said support, a pressure-sensitive adhesive layer bonded to the opposite surface of said support, and a layer of an ethylene polymer peelably adhered to said adhesive layer, said polymer layer having been formed by extruding molten ethylene polymer having a melt index in the range from about 3 to 14 and a temperature above 450° F onto said adhesive layer on said support, the bond strength between said polymer layer and said pressure-sensitive adhesive layer being such that a force not exceeding 400 grams will peel a strip of said polymer layer ½ inches wide and at least 10 inches long from said adhesive layer at room temperature at a rate of 10 inches per minute after said element is room temperature aged for at least 15 days after extrusion.

2. A photographic element as described in claim 1 wherein said temperature is in the range from about 490° to 600° F.

3. A photographic element as described in claim 2 wherein said ethylene polymer additionally comprises an antioxidant.

4. A photographic element as described in claim 3 wherein said antioxidant is a phenol, bisphenol, or dialkyl phenol sulfide at a concentration in the range from about 0.2 to about 1 percent by weight of ethylene polymer.

5. A photographic element as described in claim 4 wherein said antioxidant is octadecyl-3-(3',5'-di-tert-butyl-4'-hydroxyphenyl)propionate and said temperature is in the range from about 575° to about 600° F.

6. A photographic element as described in claim 1 wherein said ethylene polymer is polyethylene having a melt index in the range from about 6 to 12 and said bond strength is such that a force not exceeding 200 grams will peel said polymer layer as described.

7. A photographic element as described in claim 6 wherein said melt index is about 7.5 and said extrusion temperature is in the range from about 490° to about 540° F.

8. A photographic element as in claim 1 wherein said ethylene polymer layer has a thickness less than 1 mil.

* * * * *